United States Patent [19]

Vaughan, deceased et al.

[11] Patent Number: 4,592,814

[45] **Date of Patent: * Jun. 3, 1986**

[54] ELECTROCHEMICAL SYNTHESIS OF HUMIC ACID AND OTHER PARTIALLY OXIDIZED CARBONACEOUS MATERIALS

[75] Inventors: Ronald J. Vaughan, deceased, late of Orinda; by Bank of America NT&SA, administrator, Walnut Creek, both of Calif.

[73] Assignee: Chevron Research Company, San Francisco, Calif.

[ * ] Notice: The portion of the term of this patent subsequent to Jun. 21, 2000 has been disclaimed.

[21] Appl. No.: 653,664

[22] Filed: Sep. 21, 1984

Related U.S. Application Data

[63] Continuation-in-part of Ser. No. 496,799, May 23, 1983, abandoned.

[51] Int. Cl.[4] ..... C25B 3/02

[52] U.S. Cl. ..... 204/78; 204/80; 204/101; 204/128; 204/266

[58] Field of Search ..... 204/72, 78, 79, 101, 204/128, 80

[56] References Cited

U.S. PATENT DOCUMENTS

| | | | |
|---|---|---|---|
| 3,761,369 | 9/1973 | Tirrel | 204/108 |
| 3,920,791 | 11/1975 | Meyers | 423/461 |
| 4,081,338 | 3/1978 | Golovoy | 204/149 |
| 4,194,972 | 3/1980 | Weintraub et al. | 210/43 |
| 4,202,744 | 5/1980 | Pan et al. | 204/129 |
| 4,268,363 | 5/1981 | Coughlin | 204/101 |
| 4,279,710 | 7/1981 | Coughlin | 204/101 |
| 4,341,608 | 7/1982 | St. John | 204/129 |
| 4,389,288 | 6/1983 | Vaughan | 204/101 |
| 4,405,420 | 9/1983 | Vaughan | 204/105 |
| 4,412,893 | 11/1983 | Fray et al. | 204/105 |

OTHER PUBLICATIONS

J. Electrochem. Soc., vol. 129, No. 8, pp. 1719–1724, Aug. 1982.

Lynch et al, "The Electrolytic Oxidation of Coal", pp. 408–415 (1932).

*Primary Examiner*—T. Tung

*Attorney, Agent, or Firm*—S. R. LaPaglia; R. C. Gaffney; G. F. Swiss

[57] ABSTRACT

A continuous cyclic electrolytic/carbon oxidation process wherein ferrous ion is oxidized at the anode and hydrogen is generated at the cathode of an electrolytic cell. The ferric ions produced at the anode are thereafter reduced to ferrous ions by contact with a solid carbonaceous material and the ferrous ions recycled for electrochemical reoxidation. The process produces partially oxidized organic products from the combustion process in high yield.

9 Claims, 3 Drawing Figures

ELECTROCHEMICAL SYNTHESIS OF HUMIC ACID AND OTHER PARTIALLY OXIDIZED CARBONACEOUS MATERIALS

This application is a continuation-in-part of U.S. Ser. No. 496,799, filed on May 23, 1983, abandoned.

BACKGROUND OF THE INVENTION

1. Field of the Invention

This invention relates to a process for producing humic acid and other partially oxidized carbonaceous materials via an electrolytic cell. More particularly, the compositions of this invention are prepared by a continuous cyclic technique wherein (a) $Fe^{+2}$ ion is oxidized to $Fe^{+3}$ in an aqueous acidic electrolyte at the anode of an electrolytic cell with the corresponding production of hydrogen or a metal at the cathode, and (b) the reduction of $Fe^{+3}$ generated at the anode with a solid carbonaceous reductant material to $Fe^{+2}$ for subsequent reuse in the process.

2. Prior Art

It is well known that carbon and carbonaceous materials may be oxidized at the anode in an electrolyte in an electrochemical cell through which a direct current flows.

Recently, a renewed interest in the electrochemical oxidation of carbonaceous materials has developed wherein coal-assisted generation of hydrogen, or deposition of metals, has been proposed. Thus, U.S. Pat. No. 4,268,363 teaches the electrochemical gasification of carbonaceous materials by anodic oxidation which produces oxides of carbon at the anode and hydrogen or metallic elements at the cathode of an electrolysis cell.

U.S. Pat. No. 4,226,683 teaches the method of producing hydrogen by reacting coal or carbon dust with hot water retained as water by superatmospheric pressure. The pressure is controlled by the use of an inert dielectric liquid which washes the electrodes and while doing so depolarizes them by absorption of the gases.

U.S. Pat. No. 4,233,132 teaches a method wherein the electrodes are immersed within oil which forms a layer over a quantity of water. When current is passed between the electrodes, water is caused to undergo electro-decomposition. Gaseous hydrogen is collected in the sealed space above the oil-water layers, and the oxygen is believed to react with the constituents in the oil layer.

Fray et al., British Patent Application No. 2,087,431 A, disclose that Fe (III) ions generated at the anode of an electrochemical cell may be reduced to Fe (II) ions by contacting the Fe (III) ions with lignite at a temperature greater than 40° C. in a vessel external to the cell.

These represent some of the prior art in attempting to produce useful rates of electrochemically assisted oxidation of carbonaceous fuels. A further example is the use of carbonaceous fuels at the anode of a fuel cell, such devices having failed to achieve commercial realization due to the produces of combustion reducing the efficienty of the system, tars forming on the catalytic surfaces, and the poisoning effect of sulfur and CO.

In view of these problems, it was not thought that the partial electrochemical oxidation of carbonaceous material would selectively produce humic acid, fulmaric acid, carbon black, and other partially oxidized materials. These partially oxidized carbonaceous products find utility in a wide range of industries. For example, among other uses, humic acid is employed as a constitutent in drilling mud.

It has been discovered that these partially oxidized carbonaceous compositions may be prepared by (a) passing an aqueous acidic electrolyte solution containing iron (II) ions to an electrolytic cell comprising a cathode and an anode;

(b) passing a direct current through said solution, thereby anodically oxidizing at least a portion of said iron (II) ions to iron (III) ions with generation of hydrogen at the cathode;

(c) passing said hydrogen and said iron (III) ions from the cell;

(d) reducing the iron (III) ion oxidation product in the aqueous acidic electrolyte to iron (II) ions by contacting the same with a solid carbonaceous reducing agent at a temperature in the range of from 100° C. to 200° C.; and (e) recycling at least a portion of the aqueous acidic electrolyte containing the iron (II) ions from step (d) to step (a) until sufficient current has been passed through the cell to elevate the oxygen level of the carbonaceous material to between 10% and 40%.

U.S. Pat. No. 4,202,744 teaches a method wherein elemental iron is oxidized in an aqueous solution of an alkali metal hydroxide at the anode of an electrolytic cell with simultaneous generation of hydrogen at the cathode. The iron oxidation products of the reaction are thereafter reduced to elemental iron by contact with a carbonaceous reducing agent at elevated temperatures and the reduced material recycled for reoxidation. Carbon monoxide is the preferred reducing agent and temperatures above 1000° F. are recommended.

SUMMARY OF THE INVENTION

As described above, it is well known that carbonaceous material such as coal can be oxidized at the anode of an electrochemical cell containing an aqueous acidic electrolyte with the simultaneous production of oxides of carbon at the anode and hydrogen or a metal at the cathode. For example, focusing on the carbon in coal and representing it by C, this anodic reaction can be written according to the stoichiometry:

$$C_{(s)}+2H_2O_{(l)}\rightarrow CO_{2(g)}+4H^{+}+4e^{-}\quad E^{\circ}=0.21\text{ volt} \qquad \text{(I)}$$

in combination with the simultaneous cathodic reaction $$M^{+m}+me^{-}\rightarrow M \qquad \text{(II)}$$

which for hydrogen is $$4H^{+}+4e^{-}\rightarrow 2H_{2(g)}\quad E^{\circ}=0.0\text{ volts} \qquad \text{(IIa)}$$

Thus, the net reaction for production of hydrogen, that is the sum of equations (I) and (IIa), is:

$$2H_2O_{(l)}+C_{(s)}\rightarrow CO_{2(g)}+2H_{2(g)}\quad E^{\circ}=0.21\text{ volt} \qquad \text{(III)}$$

In these equations, E° is the standard thermodynamic electrode potential and the symbols (g), (s) and (l) symbolize the gaseous, solid and liquid states, respectively. Equation (III), the reaction between coal and water, caused by impressing a potential of 0.21 volt or more on a suitable electrochemical cell, is what is referred to in U.S. Pat. No. 4,268,363 as the electrochemical gasification of coal, which reference is incorporated totally herein by reference.

Also, as disclosed in U.S. Pat. No. 4,389,288 which issued June 21, 1983, the addition of a sufficient amount of iron preferably in the +2 or +3 valence state or mixtures thereof to the carbonaceous material undergoing oxidation in an aqueous acidic electrolyte at the anode will increase the rate of reaction of the oxidation process. The iron catalyst assists the oxidation of carbonaceous material at the anode in going to completion and increases the amount of current produced at the anode per given operating voltage.

It was further disclosed in U.S. Ser. Nos. 496,798 and 496,799 that the solid carbonaceous material undergoing oxidation in the aqueous acidic electrolyte in the presence of $Fe^{+2}$ and $Fe^{+3}$ ions does not have to be present at the anode for the production of hydrogen or metal at the cathode to take place.

It has been discovered that partially oxidized products may be prepared in a continuous process by (a) passing an aqueous acidic electrolyte solution containing $Fe^{+2}$ ions to an electrolytic cell comprising a cathode and an anode; (b) passing a direct current through said solution thereby anodically oxidizing at least a portion of said $Fe^{+2}$ ions to $Fe^{+3}$ ions with generation of hydrogen at said cathode; (c) passing said hydrogen and said $Fe^{+3}$ ions from the cell; (d) reducing the $Fe^{+3}$ ion oxidation product in the aqueous acidic electrolyte to $Fe^{+2}$ ions by contacting the same with a solid carbonaceous reducing agent at a temperature in the range of from 25° C. to 350° C.; and (e) recycling at least a portion of the aqueous acidic electrolyte containing the $Fe^{+2}$ ions from step (d) to step (a) until sufficient current has been passed through the cell to elevate the oxygen level of the carbonaceous material to between about 10% and 40%.

While not being limited by the theory involved in the process, it is believed that $Fe^{+3}$ ions react spontaneously with the carbon or hydrocarbon surface to form $Fe^{+2}$ ions. The $Fe^{+2}$ ions are oxidized by the anode electrode in preference to either the direct oxidation with carbon or the electrolysis of water, i.e., the evolution of $O_2$ at the anode. For the oxidation reaction of $Fe^{+2}$ to $Fe^{+3}$ at the anode, depending upon anions present, temperature, etc. this voltage is about $E^\circ=0.77$ volts. The presence of the iron catalyst does not interfere with the oxidation of $S^{--}$ to $SO_4^{--}$ or the oxidation of nitrogen groups which may be present on the carbonaceous material. This is characteristic of the electrochemical oxidation process and different from the direct oxidation of fuels by air, alone. The oxygen is provided by water which is present in abundance.

Fuels may be compounds or mixtures of solid organic materials such as tars, coal, coke, and any other carbonaceous material containing less than 30% oxygen. The prerequisite is an abundance of carbon in the structure. The process is unlike the oxidation of fuels in air, both in principle and effect. The products of the electrochemical or catalyzed oxidation do not contain significant amounts of partially combusted material such as finely divided aerial smokes, CO, sulfur dioxide, and nitrogen oxides characteristic of combustion with air or oxygen; however, a unique set of partially oxidized products are produced due to the very different mechanism of carbon oxidation with water and subsequent hydrolysis of the initial oxidation products. The rate of the oxidation of the carbonaceous material in the electrolyte has been found to be influenced by the presence of a catalyst $Fe^{+3}$ ion, which is inexpensive, nontoxic, and abundant.

The oxidation of the carbonaceous material is controlled by the process of the instant invention so that partially oxidized products are obtained. Particularly valuable partially oxidized products such as humic acid and carbon black may be produced by the process of the instant invention.

BRIEF DESCRIPTION OF THE DRAWINGS

While not essential to the understanding of the invention, the invention will be better understood by reference to the appended drawings in which:

FIG. 2 is a schematic representation of a preferred system showing the separation of coal or other solid carbonaceous material from the anode compartment of the electrochemical cell through which the electrolyte must pass and make contact with.

DETAILED DESCRIPTION OF THE INVENTION

Figure 1:
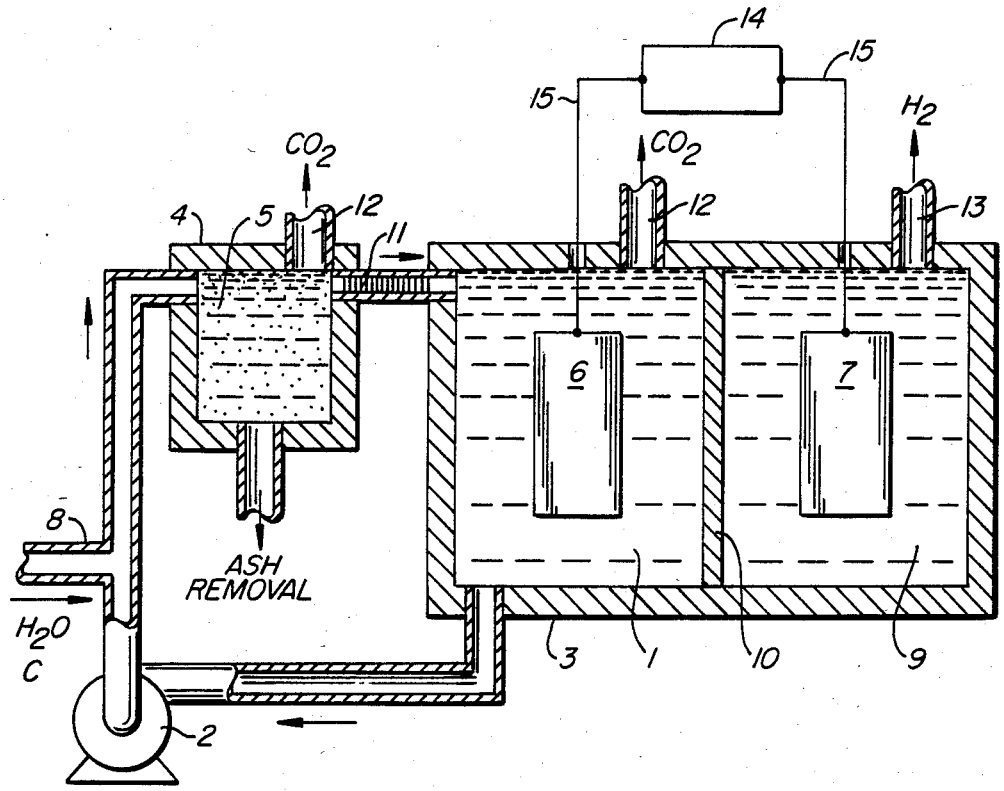
FIG. 1 is a schematic diagram of an electrochemical cell showing the operation of the continuous feed of electrolyte containing the ferrous-ferric ions to the anode compartment after contacting solid carbonaceous material external to the anode compartment.

In accordance with the present invention, there is provided a continuous two-step cyclic method for partially oxidizing carbonaceous material. Broadly, the first step comprises reacting a carbonaceous material, water and $Fe^{+3}$ ions to form reaction products including partially oxidized organic products, such as polycarboxylic acids, phenolic compounds, quinones, humic acid, carbon black, sulfones, etc., and of course $CO_2$, $Fe^{+2}$ ions and $H^+$ ions. In a second step, the $Fe^{+2}$ and $H^+$ ions are reacted in an electrochemical cell to produce $Fe^{+3}$ ions at the anode and hydrogen or a metal at the cathode, the hydrogen or metal being recoverable as a salable product and the $Fe^{+3}$ ions being recovered for recycle to the first step for reaction with additional carbonaceous material and water.

More specifically, the process may be described in terms of two distinct parts. Part 1 is the partial oxidation of crude fuel with the $Fe^{+3}$ ion catalyst in an acidic aqueous electrolyte, producing products such as humic acid, carbon black, etc., and $H^+$ ions. The iron catalyst is itself reduced to $Fe^{+2}$ ions. The reactions may be written as follows:

$$C+2H_2O+4Fe^{+3}\rightarrow \text{partially oxidized } C+4Fe^{+2}+4H^+$$

where C is the carbonaceous material or crude fuel. Part 2 is the electrolytic cell reaction wherein $Fe^{+2}$ is oxidized to $Fe^{+3}$ at the anode and the transport of the protons produced through the membrane or barrier into the cathode compartment for recombination as hydrogen gas or reduction and deposition of a metal at the cathode. The reaction for hydrogen production may be written as follows:

$$4H^++4e\rightarrow 2H_2,\ E^\circ=0.0 \text{ volts At the cathode.}$$

$$4Fe^{+2}-4e\rightarrow 4Fe^{+3},\ E^\circ=0.77 \text{ volts At the anode.}$$

It will be understood that a deposition of a metal is also contemplated in this invention.

According to the process of this invention, electrode potentials of about 0.4 to 0.8 volts versus the Standard Calomel Electrode are suitable in carrying out the electrochemical reaction described in step 2 above, i.e., the oxidation of $Fe^{+2}$ to $Fe^{+3}$ ions and the generation of hydrogen at the cathode.

The present invention, therefore, produces pure hydrogen or the electrodeposition of a metal at the cathode while producing partially oxidized carbonaceous materials.

A further benefit of this invention is the fact that the reaction conditions with respect to temperature and pressure can be the same for Parts 1 and 2 described above, or they may be different. For example, it may be preferable to use higher temperatures and pressures for the oxidation of the solid carbonaceous fuel wherein $Fe^{+3}$ is reduced to $Fe^{+2}$ as compared to electrochemical reactions wherein $Fe^{+2}$ is oxidized to $Fe^{+3}$ at the anode and hydrogen is produced at the cathode.

The electrolytic cell reactions are typically conducted at temperatures from above the freezing point of water to temperatures of about 400° C.. Temperatures of from about 25° C. to 350° C. are preferred and from about 90° C. to 300° C. are most preferred.

The partial oxidation of the carbonaceous material may be conducted under the same conditions of temperature and pressure as the electrolytic cell reactions, with temperatures of from 100° C. to 200° C. being most preferred. At temperatures below 120° C., the reactivity of solid carbonaceous materials such as coke steadily decreases as the oxidation proceeds. This decreased reactivity is believed to be caused by oxygen-containing functional groups building on the surface of the coke which hinders further sustained reactivity of the crude fuel. At temperatures of about 120° C. and greater, the reactivity of the coke is sustained and no substantial decrease is observed.

Since it is desired to maintain the reaction in a liquid phase, it is, of course, necessary that at elevated temperatures, the reaction be carried out at elevated pressure. Generally, pressures of from about 2 to 400 atmospheres are satisfactory.

On the other hand, lower temperatures, such as 100° C. to 200° C., allow for the manageable production of partially oxidized products such as oxidized carbon, carbon black, humic acid, fulvic acid and to a minor extent, lower molecular weight organic acids.

As used herein, the term "humic acid" means a high molecular weight, approximately 1000, black, insoluble acid material. It has a carbon:oxygen:hydrogen ratio of approximately 2.4–3.0:1:1. Characterization studies indicate a high degree of aromaticity and functionalization, including carbonyl, lactone, carboxylic and phenolic groups. The humic acid produced by the instant invention finds utility as a fertilizer additive.

The production of humic acid may be maximized by elevating the oxygen content of the carbon source to approximately 30% to 40% of the total composition. This may be accomplished by passing current through the cell to theoretically combust approximately 40% of the available carbon to $CO_2$.

As used herein, the terms "theoretical combustion" and "theoretically combust" are meant to indicate the extent of oxidation of the carbonaceous material. As such, the theoretical combustion of 40% of the available carbon to $CO_2$ is used as a measure of the extent of oxidation of the carbonaceous material rather than to indicate that 40% of the available carbon has been combusted to $CO_2$.

Thus, another aspect of the present invention is a process for the production of humic acid which comprises the steps:

(a) passing an aqueous acidic electrolyte solution containing iron (II) ions to an electrolytic cell comprising a cathode and an anode;

(b) passing a direct current through said solution, thereby anodically oxidizing at least a portion of said iron (II) ion to iron (III) ions with generation of hydrogen at said cathode;

(c) passing said hydrogen and said iron (III) ions from the cell;

(d) reducing the iron (III) ion oxidation product in the aqueous acidic electrolyte to iron (II) ions by contacting the same with a solid carbonaceous reducing agent at a temperature in the rate of from 100° C. to 200° C.; and (e) recycling at least a portion of the aqueous acidic electrolyte containing the iron (II) ions from step (d) to step (a) until sufficient current has been passed through the cell to elevate the oxygen level of the carbonaceous material to between 30% and 40%.

Another valuable product which may be prepared by partial combustion of a carbonaceous material in the process of the instant invention is carbon black. The carbon black produced by the instant invention finds utility in the preparation of tire treads, belt covers, etc.

Carbon black production may be maximized in the process of the instant invention by elevating the oxygen content to approximately 10% of the total composition. This may be accomplished by passing sufficient current through the cell to theoretically combust approximately 10% of the available carbon to $CO_2$.

Thus, still another aspect of the present invention is a process for the production of carbon black which comprises the steps:

(a) passing an aqueous acidic electrolyte solution containing iron (II) ions to an electrolytic cell comprising a cathode and an anode;

(b) passing a direct current through said solution, thereby anodically oxidizing at least a portion of said iron (II) ions to iron (III) ions with generation of hydrogen at said cathode;

(c) passing said hydrogen and said iron (III) ions from the cell;

(d) reducing the iron (III) ion oxidation product in the aqueous acidic electrolyte to iron (II) ions by contacting the same with a solid carbonaceous reducing agent at a temperature in the range of from 100° C. to 180° C.; and (e) recycling at least a portion of the aqueous acidic electrolyte containing the iron (II) ions from step (d) to step (a) until sufficient current has been passed through the cell to elevate the oxygen level of the carbonaceous material to about 10%.

At percentages between about 10% and 40% of available carbon which is theoretically combusted to $CO_2$, mixtures of humic acid and carbon black are obtained. The closer this percentage is to 40%, the greater the amount of humic acid is present in the mixture, while at percentages closer to 10%, carbon black dominates.

As noted above, the lower temperatures employed to maximize the production of either humic acid or carbon black also result in the decreased reactivity of the carbonaceous material to oxidation. For example, at these lower temperatures (below 120° C.), it has been found that the rate of oxidation diminishes and approaches zero after 40% of the available carbon has theoretically been converted to $CO_2$. Accordingly, in order to obtain faster rates for the synthesis of humic acid, it is preferred that mixtures of carbon black and humic acid be prepared. Most preferably, high yeilds of humic acid and carbon black are obtained at relatively fast rates when 20% to 25% of the total available carbon is theoretically combusted to $CO_2$.

The carbonaceous materials suitable for use in accordance with the present invention include a wide variety of fuels such as: bituminous coal, chars made from coal, soot, tars, active carbons, coke, carbon black, and graphite hydrocarbon residues, glassy carbon or any other carbonaceous material containing less than 30% oxygen. As disclosed in U.S. Ser. No. 496,798, which is incorporated herein by reference, instead of generating hydrogen at the cathode, it is possible to electroplate or electrodeposit any element that can be cathodically reduced from solution with simultaneous electrochemical anodic oxidation of $Fe^{+2}$ ions. Typical metallic elements often deposited in practice from aqueous electrolytes of an appropriate salt include Ag, Cr, Mn, Co, Ni, Cu, Zn, Ga, Cd, In and Tl. Preferably the metallic elements are Cu, Zn, Ni, and Pb. Electrodeposition of these metals at the cathodes is included within the scope of the invention.

Acidic aqueous electrolytes having a range of 1 to 6 pH may be used; the limiting factor is the solubility of the iron catalyst. The preferred acidic aqueous electrolytes that can be employed have a pH of less than 3 and include solutions of strong acids such as sulfuric acid, nitric acid, hydrochloric acid, phosphoric acid, and the like or mixtures thereof.

Iron may be used in its +2 and +3 valence states. Thus, inorganic iron compounds such as iron oxides, iron carbonate, iron silicates, iron sulfide, iron oxide, iron hydroxide, iron halides, iron sulfate, iron nitrate, and the like, may be used. Also, various organic iron salts and complexes such as salts of carboxylic acids, e.g., iron acetates, iron citrates, iron formates, iron gluconates, and the like, iron cyanide, iron chelate compounds such as chelates with diketones as 2,4-pentanedione, iron ethylene diaminetetracetic acid, iron oxalates, and the like.

While the iron catalyst may be used at a concentration up to the saturation point in the aqueous electrolyte, the preferred range of iron catalyst is in the range of from 0.05 to 0.5 molar and most preferably from 0.05 to 0.2 molar concentration. While certain carbonaceous materials such as coal may contain iron as an impurity, an iron-containing catalyst from an external source is generally required in order to increase the rate of reaction, at least initially, to acceptable levels for commercial use. The iron catalyst can conceivably be generated in-situ by initially leaching iron from the coal and subsequently oxidizing sufficient iron-containing coal to generate an effective amount of iron catalyst in the electrolyte.

Of course, essentially iron-free carbonaceous materials, such as carbon black, require an iron catalyst to be added from an external source. However, the degree of iron addition may be adjusted to either increase the reaction rate, or, by opting to operate with very low concentrations of iron, operate at lower electrode potential and lower current density.

Thus, in one embodiment of this invention, sufficient iron in the form of $Fe^{+2}$ or $Fe^{+3}$ is added from an external source in order to supply the preferred range, namely 0.05 to 0.5 molar or higher.

In a second embodiment, an effective amount of iron in the form of $Fe^{+2}$ or $Fe^{+3}$ can be generated in-situ by initially leaching iron ions from the coal and subsequently oxidizing sufficient iron-containing coal, albeit initially at a slower rate, to supply the preferred range of catalyst or higher.

The catalyst generated would then be freed from the coal and be able to function in a similar manner as externally supplied iron.

In a third embodiment, a combination of externally supplied iron and in-situ solubilized iron can be used to supply the preferred range of catalyst, i.e., 0.04 to 0.5 molar or higher.

A fourth embodiment is the presence of catalysts, such as metal ions that promote the oxidation rate either as catalysts, such as silver or the precious metals, or as variable oxidation state transition metals, such as cerium. Although not essential for the efficient operation of the process, it is recognized that often they occur naturally in the system after repeated operation, or they may be added to create an additional effect such as more complete oxidation or increased yields of fulvic acid at the expense of humic acid.

The concentration or amount of carbonaceous material present in the electrolyte may vary over a wide range depending on particle size; however, the preferred range is from about 0.05 gram to 0.3 gram per ml. The preferred particle size range is 1 to 150 microns more preferred is the range 5 to 25 microns. The rate of regeneration of $Fe^{+2}$ is indirectly proportional to the particle size of the carbonaceous material, however, larger particles are useful as they aid the separation of electrolyte from fuel.

Additionally, other cathodic reactions, e.g. reduction of organic groups, may be employed and are within the scope of this invention.

The particular apparatus used to carry out the present invention is not critical.

FIG. 1 schematically shows an embodiment which provides partial oxidation of a carbonaceous material such as coal external to the anode compartment by $Fe^{+3}$, the oxidation of $Fe^{+2}$ ion to $Fe^{+3}$ ion at the anode, and the production of hydrogen or deposition of a metal at the cathode.

As shown in the Figure, anolyte electrolyte 1 containing ferric ion is circulated by pump means 2 from the anode compartment 3 through an oxidation reactor compartment 4 external to the anode compartment and which contains a solid carbonaceous material 5. The ferric ion oxidizes the carbonaceous material and is thus reduced to ferrous ion. The anolyte containing the ferrous ion is returned to the anode compartment where it electrochemically reacts at the anode 6 to form ferric ions with the simultaneous production of hydrogen or deposition of a metal at the cathode 7. Carbonaceous material and water is fed at 8. The electrochemical cell also includes catholyte electrolyte 9, ion-permeable membrane 10, and means 11 for containing the carbonaceous material 5 in the reactor compartment such as a porous glass frit, spun or woven asbestos, porous reinforced polymers or an ion exchange membrane, and a means for removing $CO_2$ at 12 and $H_2$ at 13. Anode 6 and cathode 7 of the electrochemical cell are electrically connectd to DC power source 14 by wires 15. Any ash or partially oxidized material formed from the chemical oxidation of the carbonaceous material may be removed.

Figure 2:
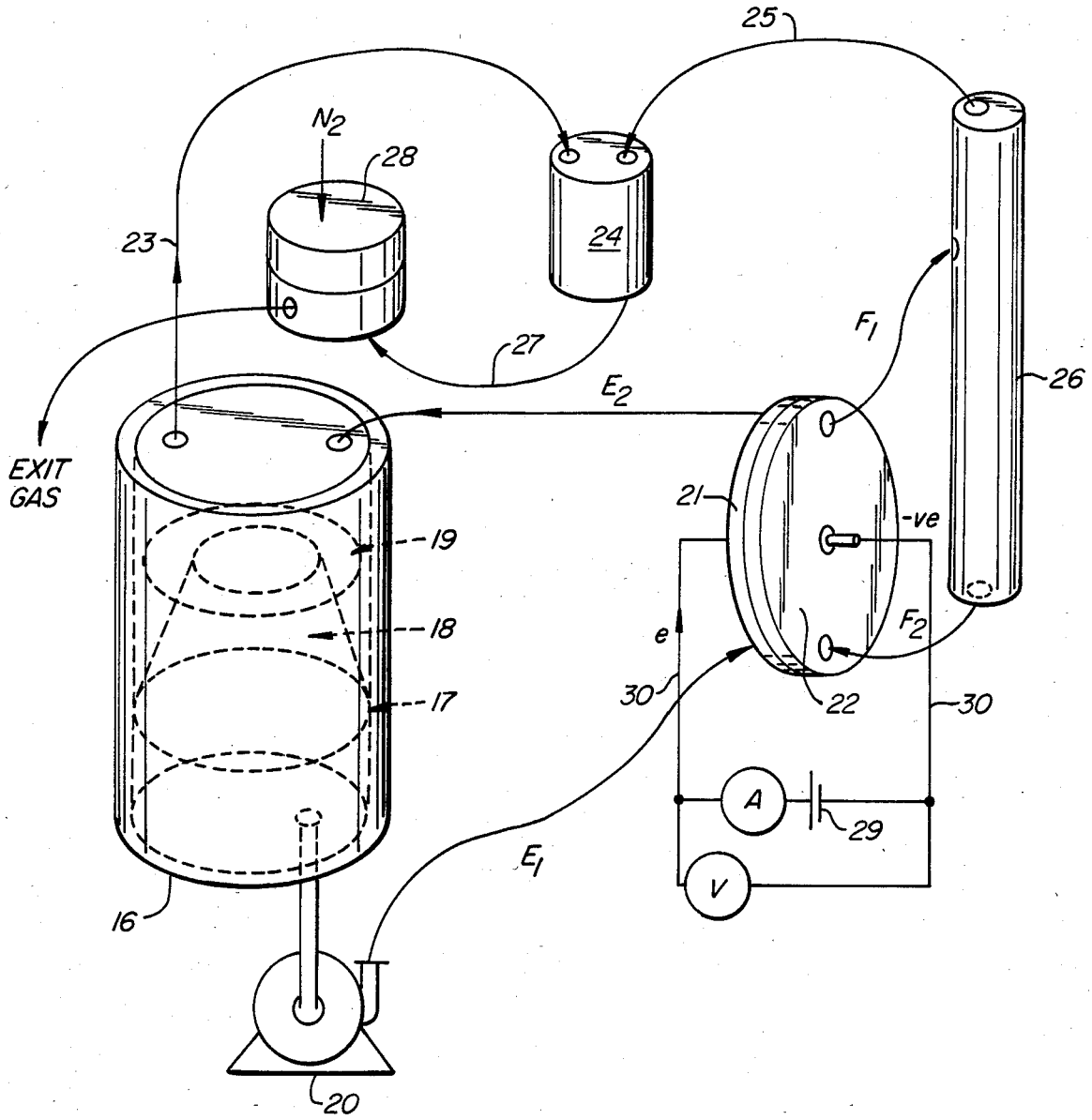

FIG. 2 shows a preferred arrangement of reactor and cells with which the cycle may be arranged.

The reactor or digestor 16 is a pressure vessel with a separator means 17 for the solids which supports the bed 18. The anolyte electrolyte level is shown at 19. A pump 20 circulates the $Fe^{+2}$ anolyte electrolyte solution to the anode compartment 21 of the cell 22 as $E_1$ stream. The cell is shown as 22, the internal parts of which are described in FIG. 3, and has two flows, $E_1/E_2$ the anolyte, and $F_1/F_2$ the catholyte. $E_2$ is the exiting ferric solution from the anode reactor. Carbon dioxide and water vapors are fed through 23 to a pressure equalizer 24 where they are combined with the hydrogen through 25 issuing from the electrolyte reservoir at 26. The combined gases are fed through 27 to a Grove Loader 28 which is pressurized by nitrogen to control the exit pressure of the system.

Not that reservoir 26 is used to separate the electrolyte $F_1/F_2$ from the hydrogen produced in the cell.

It will be obvious to those skilled in the art that this system allows for reliable measurement of the mass and energy balances that are taking place in the reactor and in the electrochemical cell.

The presence of some solid crude fuel in the electrolyte at the anode may be beneficial. Firstly, it provides additional fuel to the electrode, especially beneficial when the concentration of $Fe^{+3}$ is declining at the upper end of the electrode; and secondly, the presence of fine particles would enhance the mixing process at the electrode-electrolyte interface.

The crude fuel added to the reactor 16 as finely divided particles or as an oily waste or tar dispersed with coke or oxidized carbon powders, preferably has a particle size in the range of 1 to 150 microns. During the oxidation process, there is a natural reduction in the particle size of the solid carbonaceous material. Reduction in particle size has an effect on the rate of reaction, finely ground material has a larger surface area and therefore many more sites for oxidation to take place.

The reactor principle allows for a much larger degree of accommodation to be made for particle size distribution and type of fuel. For example, there are occasions when larger particle size in the order of 200 or 300 microns and larger may aid the management of the process by improving the filterability or separation of the oxidized products from the electrolyte stream during or at the end of the process.

The anode and cathode of the electrochemical cell are elecrically connected to DC power source 29 by wires 30.

Figure 3:
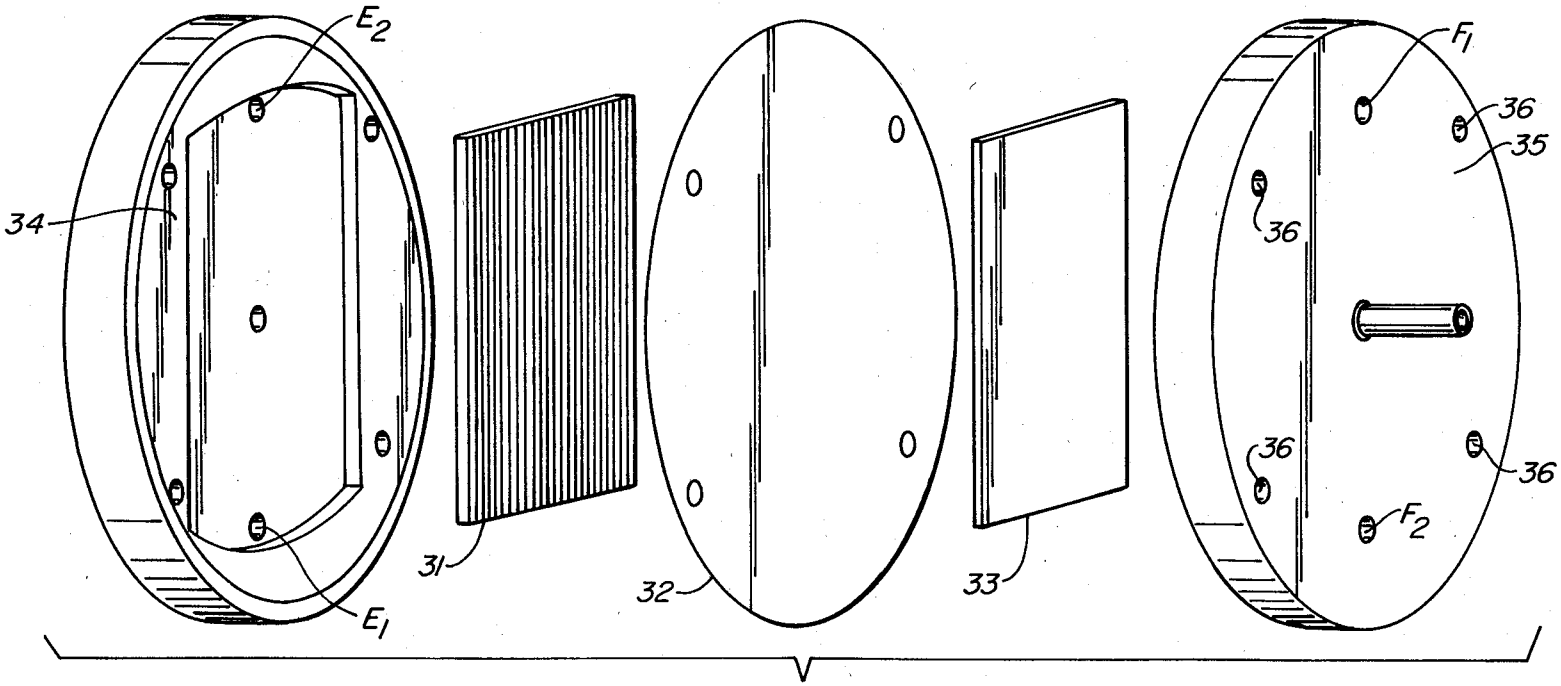
FIG. 3 is a schematic representation of a cell containing an anode, cathode and membrane separator.

FIG. 3 is a schematic representation of cell 22 used in the preferred system described in FIG. 2. The cell was designed to operate above atmospheric pressure; however, the cell may also be operated at ambient pressure. FIG. 3 shows an anode 31 which may be made from any material that will tolerate the chosen conditions of the electrolyte, temperature and pressure. Typical of the electrodes used include $RuO_2/TiO_2$ on a titanium substrate or $IrO_2/TiO_2$ on a titanium substrate; however, sintered titanium oxide, $Ti_4O_7$, known commercially as Ebinex®, would serve equally as well. Carbon, or glassy carbon electrodes, would provide a cheaper alternative. The membrane 32 chosen to substantially separate the hydrogen evolving at cathode 33 was made from Nafion® (available from E. J. DuPont & Co., Wilmington, Del.), a resin composed of polytetrafluoroethylene and having terminal sulfonic acid groups. These membranes are available commercially and are used at cationic exchangers in a variety of industrial processes.

The internal body of the cell 34, that part exposed to the acid electrolyte and catalyst as well as the pumps, lines and digestor 16, were made from Teflon. Alternative materials would be high-density polyethylene, glass filled resin, Kynar® (available from Port Plastics and other supply houses), and other plastics and special rubbers capable of performing in this environment. The outer casing 35 was made from steel or stainless steel.

The unit is bolted together through holes 36 to form a leak-free, two-compartment cell having entry and exist ports for both electrolyte streams $E_1/E_2$ and $F_1/F_2$ described hereinabove.

The membrane 32 may be dispensed with and replaced with an interference barrier used to inhibit the reduction of the $Fe^{+3}$ ion catalyst at the cathode of the cell. This could take the form of a porous ceramic diaphragm or glass felt cloth, placed directly over the cathode surface. Such a provision would limit the access of $Fe^{+3}$ sulfate to the surface of the cathode 33 by increasing the size and effect of the diffusion layers by impeding mixing at the surface of the electrode.

A further embodiment of this invention is to arrange for the membrane and porous electrodes to be a one unit. This technique is known as a solid polymer electrolyte cell, SPE, to those skilled in the art, and works equally as well with the invention.

The advantages of using a solid polymer electrolyte design for the hydrogen-producing cell are well documented. For example, in high-rate, high-pressure electrochemical generation of hydrogen, the problems associated with bubble screening of the electrode are conveniently dealt with, and the hydrogen gas is free of acid electrolyte spray. A further advantage is the reduction in cell gap that may be accomplished by the cell design.

Many different types of electrolytic cell configurations may be employed in carrying out the $Fe^{+2}$ ion oxidation/hydrogen production reactions. Substantially the same apparatus and techniques that are utilized in the electrolytic decomposition of water can be used with the method of this invention. Any selection or appropriate changes in use of materials and/or techniques is well within the skill of those versed in the art to which this invention applies. For example, the electrodes may be Pt, or other suitable conductors, and preferred embodiments will make use of chemically inert materials for the anode and material of low hydrogen overvoltage for the cathode. Anode materials which were found especially well suited include $RuO_2/TiO_2$ on a Ti substrate or $IrO_2/TiO_2$ on a Ti substrate, which anodes are both commercially available.

An ion-exchange membrane or diaphragm can optionally and preferably be used to separate the anode and cathode compartments of the electrolytic cell. As a cation-exchange membrane, a perfluorosulfonic acid resin can be used which has a transport number for hydrogen ion close to unity, and in this system as well as a low electrical resistance. The "Nafion®" membranes available commercially are suitable.

The following examples will serve to illustrate the invention.

EXAMPLE 1

A sample of coke, 475 grams ground to an average particle size of 25 microns and having a composition of C 89.5%, O 2.13%, N 2.67%, S 2.06%, and H 3.84%, was placed in an oxidation reactor or digestor similar to reactor 16 in FIG. 2. 1.5 Liters of electrolyte, 5 M sulfuric acid containing 0.1 M ferric sulfate, was heated to 95° C., and pumped to the electrolyte cell containing an anode and a cathode similar to that shown in FIG. 2. The anode was 50 $cm^2$ of iridium oxide/titanium dioxide coated titanium; the cathode was platinum. A Nafion TM membrane separated the anode and cathode compartments. A current of 7.5 amps was passed for 12 hours while the electrolyte was circulated continuously from cell to digestor and back. Hydrogen was produced at the cathode at a current density of 150 mA $cm^{-2}$, at a cell potential of 1.2 volts. The carbon was oxidized to produce $CO_2$ and polycarboxylated products. Hydrogen was produced at the cathode from the catholyte.

When the circulation of the electrolyte through the carbonaceous material was terminated, the current dropped to zero as the ferric sulfate concentration was depleted at the anode. Normal operating conditions were reestablished when the electrolyte circulation through the carbonaceous material was resumed.

EXAMPLE 2

The above Example 1 was repeated with a sample of coal. 425 Grams of coal with an average particle size of 50 microns and having a composition of C 68.7%, H 4.46%, N 1.41%, S 3.46%, O 18%, Fe 1.32%, and Al 1.1%, was added to the oxidation reactor or digestor. 1.5 Liters of 5 M sulfuric acid containing 0.1 M ferric sulfate was heated to 180° C. and pumped through the electrolytic cell described above in Example 1.

A current of 6.0 amps DC from a controlled current DC power supply unit was passed for 24 hours. The anodic potential was about 0.7 volts, full cell voltage was maintained at 1.2 volts during the production of hydrogen at the cathode and $CO_2$ was produced from the oxidation of the coal.

The coal remaining in the oxidation reactor or digestor after the run was analyzed. The products of combustion were found to be much higher in oxygen content, about 35% compared to 18% in the initial coal. Infrared absorbtion analysis revealed significant carbonyl, carboxylate function of the solid products of combustion. Humic acid was extracted from the residues by alkali leaching.

No significant amounts of $SO_2$ or $H_2S$ were detected in the gaseous effluents from the digestor. Carbon monoxide was below 0.1%.

EXAMPLE 3

A sample of coal, 100 grams ground to an average particle size of 50 microns and having a composition of C 68.7%, O 18%, N 1.41%, S 3.46%, and H 4.46%, was placed in an oxidation reactor or digestor similar to reactor 16 in FIG. 2. 1 Liter of electrolyte, 6 M sulfuric acid containing 0.2 M ferric sulfate, was heated to 140° C. at ambient pressure, and pumped to the electrolyte cell containing an anode and a cathode similar to that shown in FIG. 2. The anode and cathode were platinum. A Nafion TM membrane separated the anode and cathode compartments. A current of 2 amps was passed for 250 hours while the electrolyte was circulated continuously from cell to digestor and back. Under these conditions, approximately 40% of the available carbon was theoretically combusted to carbon dioxide. Hydrogen was produced at the cathode at a current density of 80 mA $cm^{-2}$, at a cell potential of 1.1 volts. The material was separated from the electrolyte by filtration and reacted with 300 mls of a 1.0 M sodium hydroxide solution added to 1 liter of water. The mixture was again filtered. Unoxidized material was left on the filter while the black solution of sodium humate passed through the filter. The black solution was acidified with 300 mls of 1 M sulfuric acid. A black precipitate formed which was filtered to yield a black solid and a clear solution of sodium sulfate the solid was dried. Analysis of the dried product corresponded to an emperical formula corresponding to humic acid.

The 100 grams of coal yield 86 grams of humic acid and 4 grams of insoluble residue.

EXAMPLE 4

A sample of coke, 50 grams ground to an average particle size of 4 microns and having a composition of C 89.5%, O 2.13%, N 2.69%, S 2.06%, and H 3.84%, was placed in an oxidation reactor or digestor similar to reactor 16 in FIG. 2. 0.5 Liter of electrolyte, 5 M sulfuric acid containing 0.2 M ferric sulfate, was heated to 180° C., at a pressure of 180 psig, and pumped to the electrolyte cell containing an anode and a cathode similar to that shown in FIG. 2. The anode and cathode were platinum. A Nafion TM membrane separated the anode and cathode compartments. A current of 1.2 amps was passed for 130 hours while the electrolyte was circulated continuously from cell to digestor and back. Under these conditions, approximately 40% of the available carbon was theoretically combusted to carbon dioxide. Hydrogen was produced at the cathode at a current density of 50 mA $cm^{-2}$, at a cell potential of 1.1 volts. The product was isolated as in Example 3 above yielding 50 grams humic acid and 0.6 grams of carbon black.

EXAMPLE 5

A sample of coke, 100 grams ground to an average particle size of 12.5 microns and having a composition of C 89.5%, O 2.13%, N 2.69%, S 2.06%, and H 3.84% was placed in an oxidation reactor or digestor similar to reactor 16 in FIG. 2. 1.0 Liter of electrolyte, 6 M sulfuric acid containng 0.2 M ferric sulfate, was heated to 140° C. at ambient pressure, and pumped to the electrolyte cell containing an anode and a cathode similar to that shown in FIG. 2. The anode and cathode were platinum. A Nafion TM membrane separated the anode and cathode compartments. A current of 2.0 amps was passed for 56 hours while the electrolyte was circulated continuously from cell to digestor and back. Under these conditions, approximately 12% of the available carbon was theoretically combusted to carbon dioxide. Hydrogen was produced at the cathode at a current density of 80 mA $cm^{-2}$, at a cell potential of 1.1 volts. The product was isolated as in Example 3 above to yielding 110 grams carbon black and 4 grams of humic acid.

EXAMPLE 6

A sample of coke, 100 grams ground to an average particle size of 50 microns and having a composition of C 89.5%, O 2.13%, N 2.69%, S 2.06%, and H 3.84%, was placed in an oxidation reactor or digestor similar to reactor 16 in FIG. 2. 1 Liter of electrolyte, 5 M sulfuric acid containing 0.2 M ferric sulfate, was heated to 140° C. at ambient pressure, and pumped to the electrolyte cell containing an anode and a cathode similar to that shown in FIG. 2. The anode and cathode were platinum. A Nafion TM membrane separated the anode and cathode compartments. A current of 4 amps was passed for 60 hours while the electrolyte was circulated continuously from cell to digestor and back. Under these conditions, approximately 20% to 25% of the available carbon was theoretically combusted to carbon dioxide. Hydrogen was produced at the cathode at a current density of 100 mA $cm^{-2}$, at a cell potential of 1.1 volts. The product was isolated as in Example 3 above to yielding 25 grams humic acid and 78 grams of carbon black.

EXAMPLE 7

A sample of coke, 100 grams ground to an average particle size of 50 microns and having a composition of C 89.5%, O 2.13%, N 2.69%, S 2.06%, and H 3.84% was placed in an oxidation reactor or digestor similar to reactor 16 in FIG. 2. 1 Liter of electrolyte, 6 M sulfuric acid containing 0.2 M ferric sulfate, was heated to 140° C. at ambient pressure, and pumped to the electrolyte cell containing an anode and a cathode similar to that shown in FIG. 2. The anode and cathode were platinum. A Nafion TM membrane separated the anode and cathode compartments. A current of 2 amps was passed for 80 hours while the electrolyte was circulated continuously from cell to digestor and back. Under these conditions, approximately 30% of the available carbon was theoretically combusted to carbon dioxide. Hydrogen was produced at the cathode at a current density of 80 mA $cm^{-2}$, at a cell potential of 1.1 volts. The coke was oxidized to yield 40 grams humic acid and 62 grams of carbon black.

EXAMPLE 8

A sample of coke, 100 grams ground to a medium particle size of 9.5 microns near particle diameters and having a composition of C 90.0%, H 3.4%, N 2.7%, O 1.78%, S 1.08%, and mayes metal components V 358 ppm, Ni 436 ppm, Ca 89.3, Na 201 was placed in the high pressure cell of digestor system. 250 lbs of 5 M sulfuric acid 0.2 M $Fe^{+3}$ solution was added and heated to 200° C. at a pressure of 250 psi.

A controlled current, responding to a set limit of 0.80 volts potential with respect to standard calomel electrode was passed, corresponding to a total energy of 1221600 conlombs. The experiment yielded 86 grams of humic acid on digestion in sodium hydroxide, and neutralization and recovery with sulfuric acid. No carbon black or insoluble residue was found in the separation process. This corresponds to a yield of 86% on the weight of the starting coke.

What is claimed is:

1. A method for the partial oxidation of carbonaceous materials which comprises the steps:

(a) passing an aqueous acidic electrolyte solution of pH 3 or less containing iron (II) ions to an electrolytic cell comprising a cathode and an anode;

(b) passing a direct current through said solution, thereby anodically oxidizing at least a portion of said iron (II) to iron (III) ions with generation of hydrogen at said cathode;

(c) passing said hydrogen and said iron (III) ions from the cell;

(d) reducing the iron (III) ion oxidation product in the aqueous acidic electrolyte to iron (II) ions by contacting the same with a solid carbonaceous reducing agent at a temperature in the range of from 100° C. to 200° C. and wherein the particle size of said solid carbonaceous reducing agent is from 1 to 150 microns; and (e) recycling at least a portion of the aqueous acidic electrolyte containing the iron (II) ions from step (d) to step (a) until sufficient current has been passed through the cell to elevate the oxygen level of the carbonaceous material to between about 10% and 40% and with the proviso that the total iron concentration as either iron (II) and/or iron (III) ions in said aqueous acidic electrolyte is from about 0.05 to 0.5 molar.

2. A method for the production of humic acid which comprises the steps:

(a) passing an aqueous acidic electrolyte solution of pH 3 or less containing iron (II) ions to an electrolytic cell comprising a cathode and an anode;

(b) passing a direct current through said solution, thereby anodically oxidizing at least a portion of said iron (II) ions to irons (III) ions with generation of hydrogen at said cathode;

(c) passing said hydrogen and said iron (III) ions from the cell;

(d) reducing the iron (III) ion oxidation product in the aqueous acidic electrolyte to iron (II) ions by contacting the same with a solid carbonaceous reducing agent at a temperature in the range of from 100° C. to 200° C. and wherein the particle size of said solid carbonaceous reducing agent is from 1 to 150 microns; and (e) recycling at least a portion of the aqueous acidic electrolyte containing the iron (II) ions from step (d) to step (a) until sufficient current has been passed through the cell to elevate the oxygen level of the carbonaceous material to between about 30% and 40% and with the proviso that the total iron concentration as either iron (II) and/or iron (III) in said aqueous acidic electrolyte is from about 0.05 to 0.5 molar.

3. The method according to claim 2 wherein step (d) is conducted at from 140° C. to 200° C.

4. The method according to claim 2 wherein said carbonaceous material is selected from the group consisting of coal, lignite, peat, char, coke, charcoal, soot, carbon black, activated carbon, asphalt, graphite, wood, rubber, plastics, biomass materials, or sewage sludge.

5. A method for the production of carbon black which comprises the steps:

(a) passing an aqueous acidic electrolyte solution of pH 3 or less containing iron (II) ions to an electrolytic cell comprising a cathode and an anode;

(b) passing a direct current through said solution, thereby anodically oxidizing at least a portion of said iron (II) ions to iron (III) ions with generation of hydrogen at said cathode;

(c) passing said hydrogen and said iron (III) from the cell;

(d) reducing the iron (III) ion oxidation product in the aqueous acidic electrolyte to iron (II) ions by contacting the same with a solid carbonaceous reducing agent at a temperature in the range of from 100° C. to 200° C. and wherein the particle size of said solid carbonaceous reducing agent is from 1 to 150 microns; and (e) recycling at least a portion of the aqueous acidic electrolyte containing the iron (II) ions from step (d) to step (a) until sufficient current has been passed through the cell to elevate the oxygen level of the carbonaceous material to about 10% and with the proviso that the total iron concentration as either iron (II) and/or iron (III) ions in said aqueous acidic electrolyte is from 0.05 to 0.5 molar.

6. The method according to claim 6 wherein step (d) is conducted at from 140° C. to 200° C.

7. A method for the partial oxidation of carbonaceous materials which comprises the steps:

(a) passing an aqueous acidic electrolyte solution of pH 3 or less containing iron (II) ions and ions of the metal to be deposited to an electrolytic cell comprising an anode and a cathode;

(b) passing a direct electric current through said solution thereby to deposit said metal on said cathode and to oxidize at least a portion of said iron (II) ions to iron (III) ions at the anode;

(c) passing said solution containing the iron (III) ions from the cell;

(d) reducing the iron (III) ion oxidation product in the aqueous acidic electrolyte to iron (II) ions by contacting the same with a solid carbonaceous reducing agent at a temperature in the range of from 100° C. to 200° C. and wherein the particle size of said solid carbonaceous reducing agent is from 1 to 150 microns; and (e) recycling at least a portion of the aqueous acidic electrolyte containing the iron (II) ions from step (d) to step (a) until sufficient current has been passed through the cell to elevate the oxygen level of the carbonaceous material to between 10% and 40% and with the proviso that the total iron concentration as either iron (II) and/or iron (III) ions in said aqueous acidic electrolyte is from 0.05 to 0.5 molar.

8. A method for the production of humic acid which comprises the steps:

(a) passing an aqueous acidic electrolyte solution of pH 3 or less containing iron (II) ions and ions of the metal to be deposited to an electrolytic cell comprising an anode and a cathode;

(b) passing a direct electric current through said solution thereby to deposit said metal on said cathode and to oxidize at least a portion of said iron (II) ions to iron (III) ions at the anode;

(c) passing said solution containing the iron (III) ions from the cell;

(d) reducing the iron (III) ion oxidation product in the aqueous acidic electrolyte to iron (II) ions by contacting the same with a solid carbonaceous reducing agent at a temperature in the range of from 100° C. to 200° C. and wherein the particle size of said solid carbonaceous reducing agent is from 1 to 150 microns; and (e) recycling at least a portion of the aqueous acidic electrolyte containing the iron (II) ions from step (d) to step (a) until sufficient current has been passed through the cell to elevate the oxygen level of the carbonaceous material to between 30% to 40% and with the proviso that the total iron concentration as either iron (II) and/or iron (III) ions in said aqueous acidic electrolyte is from 0.05 to 0.5 molar.

9. A method for the production of carbon black which comprises the steps:

(a) passing an aqueous acidic electrolyte solution of pH 3 or less containing iron (II) ions and ions of the metal to be deposited to an electrolytic cell comprising an anode and a cathode;

(b) passing a direct electric current through said solution thereby to deposit said metal on said cathode and to oxidize at least a portion of said iron (II) ions to iron (III) ions at the anode;

(c) passing said solution containing the iron (III) ions from the cell;

(d) reducing the iron (III) ion oxidation product in the aqueous acidic electrolyte to iron (II) ions by contacting the same with a solid carbonaceous reducing agent at a temperature in the range of from 100° C. to 200° C. and wherein the particle size of said solid carbonaceous reducing agent is from 1 to 150 microns; and (e) recycling at least a portion of the aqueous acidic electrolyte containing the iron (II) ions from step (d) to step (a) until sufficient current has been passed through the cell to elevate the oxygen level of the carbonaceous material to about 10% and with the proviso that the total iron concentration as either iron (II) and/or iron (III) ions in said aqueous acidic electrolyte is from 0.05 to 0.5 molar.

* * * * *